US007226344B2

(12) United States Patent
Fukao et al.

(10) Patent No.: US 7,226,344 B2
(45) Date of Patent: Jun. 5, 2007

(54) METHOD OF PROCESSING ANTIFRICTION BEARING UNIT FOR WHEEL

(75) Inventors: Takeshi Fukao, Osaka (JP); Toshihiro Nakano, Osaka (JP)

(73) Assignee: Koyo Seiko Co., Ltd., Osaka-Shi, Osaka (JP)

( * ) Notice: Subject to any disclaimer, the term of this patent is extended or adjusted under 35 U.S.C. 154(b) by 0 days.

(21) Appl. No.: 11/453,913

(22) Filed: Jun. 16, 2006

(65) Prior Publication Data

US 2006/0234608 A1 Oct. 19, 2006

Related U.S. Application Data

(62) Division of application No. 10/865,839, filed on Jun. 14, 2004, now Pat. No. 7,083,504.

(30) Foreign Application Priority Data

Jun. 12, 2003 (JP) ..... P. 2003-167785
Jun. 24, 2003 (JP) ..... P. 2003-179845
Aug. 8, 2003 (JP) ..... P. 2003-290109

(51) Int. Cl.
*B23B 3/00* (2006.01)
*B23P 17/00* (2006.01)

(52) U.S. Cl. ..... 451/246; 451/258; 451/283; 29/898.06; 29/898.09

(58) Field of Classification Search ..... 451/51, 451/52, 63, 242, 246, 247, 254, 258, 250, 451/397, 398, 402, 403, 283, 284, 290; 29/898, 29/898.04, 898.06, 898.09, 894.362; 82/1.11
See application file for complete search history.

(56) References Cited

U.S. PATENT DOCUMENTS 4,037,367 A 7/1977 Kruse
4,754,574 A * 7/1988 Clough et al. ..... 451/246
5,243,790 A 9/1993 Gagne
6,071,180 A 6/2000 Becker
6,139,405 A 10/2000 Becker
6,364,426 B1 4/2002 Horne et al.
6,415,508 B1 7/2002 Laps
6,579,156 B2 * 6/2003 Sugino et al. ..... 451/52
2002/0066185 A1 6/2002 Lustanau et al.
2003/0001345 A1 1/2003 McFadden

FOREIGN PATENT DOCUMENTS

EP 1 193 327 A1 4/2002
WO WO 00/43161 7/2000

OTHER PUBLICATIONS

European Search Report dated Oct. 6, 2004.
European Search Report dated Jan. 21, 2005.

* cited by examiner

*Primary Examiner*—Jacob K. Ackun, Jr.
(74) *Attorney, Agent, or Firm*—McGinn IP Law Group, PLLC

(57) ABSTRACT

A method of processing an antifriction bearing unit for a wheel, the antifriction bearing unit including an outer race, an inner race, a plurality of rolling elements and a flange portion for directly or indirectly mounting a brake disk provided to one of the outer and inner races, the method includes: assembling the outer and inner races and the rolling element together; after assembling, placing the one of the outer and inner race in position incapably of circumferential rotation; grinding the flange portion by bring the flange portion into contact with a grindstone which is rotated while the other of the outer and inner race is left free.

5 Claims, 7 Drawing Sheets

METHOD OF PROCESSING ANTIFRICTION BEARING UNIT FOR WHEEL

The present Application is a Divisional Application of U.S. patent application Ser. No. 10/865,839 filed on June 14, 2004 now U.S. Pat. No. 7,083,504.

BACKGROUND OF THE INVENTION

This invention relates to a method of processing an antifriction bearing unit for a wheel.

The method described in Official Gazette JP-A-2002-370104 has hitherto been known as a method of processing an antifriction bearing unit for a wheel. This method of processing an antifriction bearing unit for a wheel is such that after an outer race, an inner race and a plurality of rolling elements (rollers, balls) of a roller bearing are put together and the central axis of the antifriction bearing unit is directed vertically, the flange surface of a flange portion formed at the vertically lower end of the outer race is fixed to a fixing table for the antifriction bearing unit, while a spindle fitted in the vertically upper end of the inner race is rotated to rotate the flange surface of a flange portion formed at the vertically upper end of the inner race to bring the rotating flange surface into contact with a high-precision processing tool to grind the flange surface of the inner race.

However, the method of processing the antifriction bearing unit as described above has the drawback that, since the rotating flange surface of the inner race is brought into contact with a high-precision processing tool and is ground in a state that the outer race is fixed, the inner race which is rotating is likely to receive a large eccentric load from the high-precision processing tool and be inclined relative to the fixed outer race when the flange surface of the inner race is being ground, resulting in the deformation of the outer or inner races or the rolling elements, or the displacement of the rolling elements leading to the damage of the inner race or the rolling elements.

The necessity of large-scale apparatus for rotating the inner race, such as the spindle mentioned above, in addition to the necessity for fixing the outer race, presents the drawback of adding to the time, labor and cost for processing the antifriction bearing unit.

Further, according to the method of processing the roller bearing unit as described above, it is likely that a clearance may be formed between the inner and outer races and the rolling elements during the grinding of the flange surface of the inner race, and allow the inner race to rotate independently of the outer race, resulting in a lowering in the perpendicularity of the central axis of the roller bearing unit to the flange surface.

Further, the method of processing the roller bearing unit as described above has the drawback that in the event that a protrusion, such as the shank of a bolt, projects from the flange surface of the inner race, the protrusion interferes and makes it difficult to grind the flange surface from which the protrusion projects, and makes it difficult to grind the whole flange surface, since the rotating flange surface of the inner race is brought into contact with a high-precision processing tool and is ground in a state that the outer race is fixed.

SUMMARY OF THE INVENTION

It is, therefore, an object of this invention to provide a method of processing an antifriction bearing unit for a wheel which can prevent any deformation or damage of the outer or inner race or the rolling elements and reduce the time, labor and cost for processing an antifriction bearing unit for a wheel.

Another object of this invention to provide a method of processing a roller bearing unit for a wheel which makes it possible for a ground flange surface on an antifriction bearing unit for a wheel to have a high level of perpendicularity to its central axis.

Still another object of this invention to provide a grindstone which can easily grind the whole surface to be ground even if any protrusion may project from the surface to be ground, and a method of processing a roller bearing unit for a wheel using the grindstone.

In order to solve the aforesaid object, the invention is characterized by having the following arrangement.

(1) A method of processing an antifriction bearing unit for a wheel, the antifriction bearing unit including an outer race, an inner race, a plurality of rolling elements and a flange portion for directly or indirectly mounting a brake disk provided to one of the outer and inner races, the method comprising:

assembling the outer and inner races and the rolling element together;

after assembling, placing the one of the outer and inner race in position incapably of circumferential rotation;

grinding the flange portion by bring the flange portion into contact with a grindstone which is rotated while the other of the outer and inner race is left free.

(2) A method of processing an antifriction bearing unit for a wheel, the antifriction bearing unit including an outer race, an inner race, a plurality of rolling elements and a first flange portion for directly or indirectly mounting a brake disk provided to one of the outer and inner races, the method comprising:

assembling the outer and inner races and the rolling element together;

after assembling, placing the one of the outer and inner race in position incapably of circumferential rotation;

applying a load in an axial direction against a grindstone to the other of the outer and inner races; and grinding the first flange portion by bring the first flange portion into contact with the grindstone which is rotated while the other of the outer and inner race is being rotated.

(3) The method according to (2), wherein the load is applied to a second flange portion formed at the other of the inner and outer races.

(4) The method according to (2), wherein the grindstone is rotated in a direction opposite to a direction of rotation of the other of the inner and outer races.

(5) An apparatus for processing an antifriction bearing unit for a wheel, the antifriction bearing unit including an outer race, an inner race, a plurality of rolling elements, a first flange portion for directly or indirectly mounting a brake disk provided to one of the outer and inner races, and a bolt that passes through the first flange portion, the apparatus comprising:

a fixing table that mounts the one of outer and inner races and is adapted to rotate;

a grindstone that is provided to the fixing table and is adapted to grind the first flange portion in a state that the one of outer and inner races is mounted on the fixing table;

an engaging member that is movable in a radial direction of the fixing table and is adapted to be engaged with the bolt passing through the first flange portion to prevent the first flange portion from rotating when the fixing table mounting the one of the outer and inner races is rotated.

(6) The apparatus according to (5) further comprising a supporting member that supports the first flange portion to have radial movement of the flange portion restricted within a predetermined range when the first flange portion and the grindstone are brought into contact with each other.

(7) The apparatus according to (5) further comprising a load applying device that applies a load in an axial direction against the grindstone to the other of the inner and outer races and rotates the other of the inner and outer races when the first flange portion is ground.

(8) The apparatus according to (5), wherein the load applying device applies the load to a second flange portion formed at the other of the inner and outer races.

(9) The apparatus according to (7), wherein the grindstone is rotated in a direction opposite to a direction of rotation of the other of the inner and outer races.

(10) A grindstone comprising:

a grinding surface; and a plurality of circumferentially extending substantially arcuate slots that are formed in the grinding surface and spaced apart from one another on a circle.

(11) The grindstone according to (10) further comprising coolant grooves connected with the slots, respectively.

(12) The grindstone according to (11), wherein the coolant grooves are connected with the slots radially inwardly and outwardly.

(13) A method of processing an antifriction bearing unit for a wheel by using a grindstone, the antifriction bearing unit including an outer race, an inner race, a plurality of rolling elements, a flange portion for directly or indirectly mounting a brake disk provided to one of the outer and inner races, and a plurality of bolts that pass through the flange portion, and the grindstone including a grinding surface, and a plurality of circumferentially extending substantially arcuate slots that are formed in the grinding surface and spaced apart from one another on a circle, the method comprising:

preparing the antifriction bearing unit by fitting the plurality of bolts to the flange portion so that shanks of the bolts project from a mounting surface to be ground of the flange portion and heads of the bolts rest on a surface opposite to the mounting surface;

placing the flange portion in a position in a manner incapable of circumferential rotation; and fitting the shanks in the slots of the grindstone;

grinding the mounting surface by bringing the grinding surface of the grindstone into contact with the mounting surface and swinging the grindstone circumferentially.

(14) The method according to (13) further comprising a step of applying a load in an axial direction against the grindstone to the other of the outer and inner races and rotating the other of the outer and inner races when grinding the mounting surface.

(15) The method according to (14), wherein the grindstone is rotated in a direction opposite to a direction of rotation of the other of the inner and outer races.

DETAILED DESCRIPTION OF PREFERRED EMBODIMENTS

Embodiments according to the present invention will now be described in detail with reference to the accompanying drawings.

First Embodiment

Figure 1:
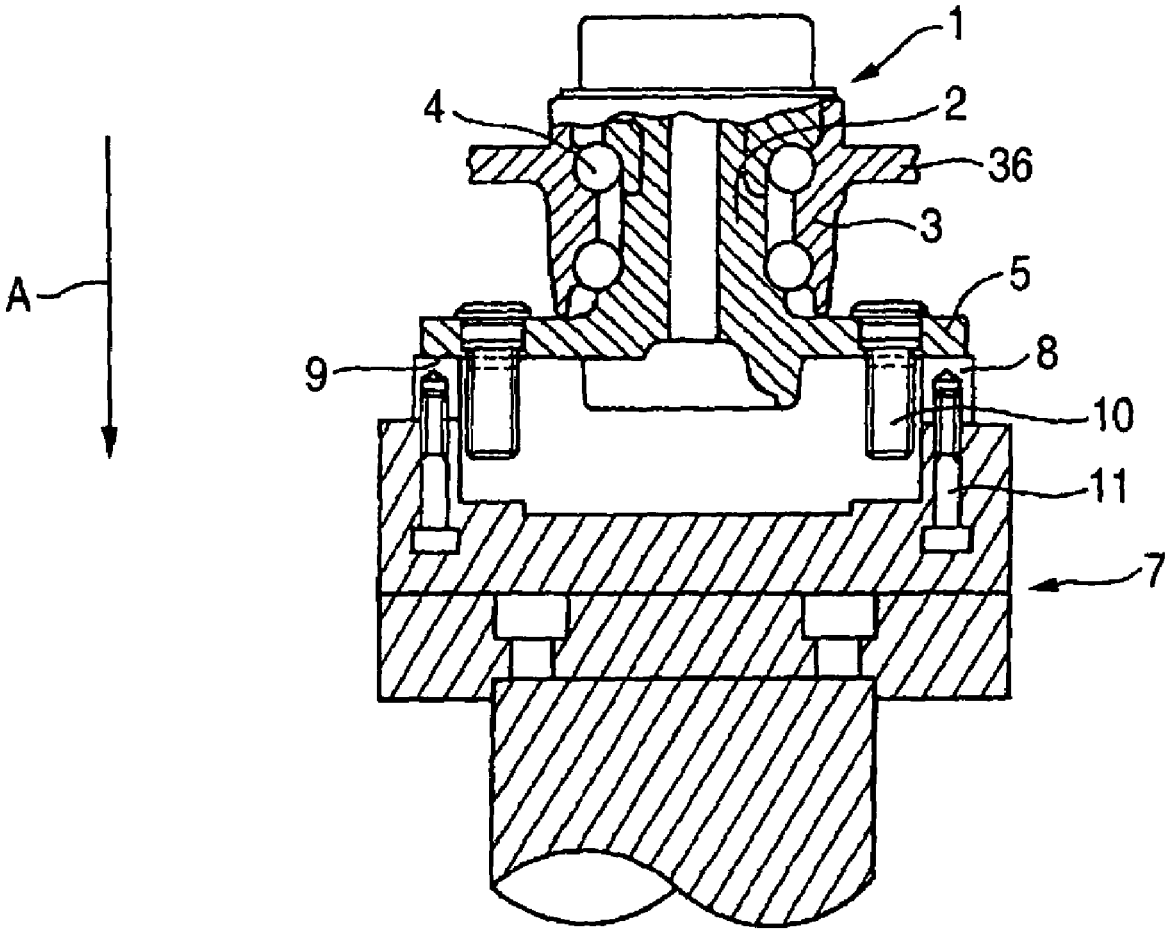
FIG. 1 is a view showing an antifriction bearing unit for a wheel as mounted on a fixing table.

FIG. 1 is a view in which an antifriction bearing unit 1 for a wheel to be processed by a method of processing an antifriction bearing unit for a wheel according to a first embodiment of the invention is mounted on a fixing table 7 for processing.

The antifriction bearing unit 1 includes an inner race 2, an outer race 3 and a plurality of balls 4 (one example of rolling elements disposed between two raceway grooves formed in the outer peripheral surface of the inner race 2 and two raceway grooves formed in the inner peripheral surface of the outer race 3.

The inner race 2 has at one axial end thereof a radially spreading disk-shaped flange portion 5 for mounting a brake disk (not shown) thereon directly or indirectly. A plurality of bolt passing holes are formed through the disk-shaped flange portion 5 on a circle concentric thereto and a plurality of bolts 10 each having its shank directed axially outwardly extend through the bolt passing holes, respectively.

The antifriction bearing unit 1 rests on the fixing table 7 by its own weight in a state that an axially outward flange surface 9 thereof is directed vertically downwardly as shown by an arrow A in FIG. 1. More specifically, the portion of the flange surface 9 which lies radially outwardly of the bolts 10 extending therethrough is held against an annular grindstone 8 that is fixed to the surface of the fixing table 7 by bolts 11 and protrudes vertically upwardly from the fixing table 7.

Figure 2:
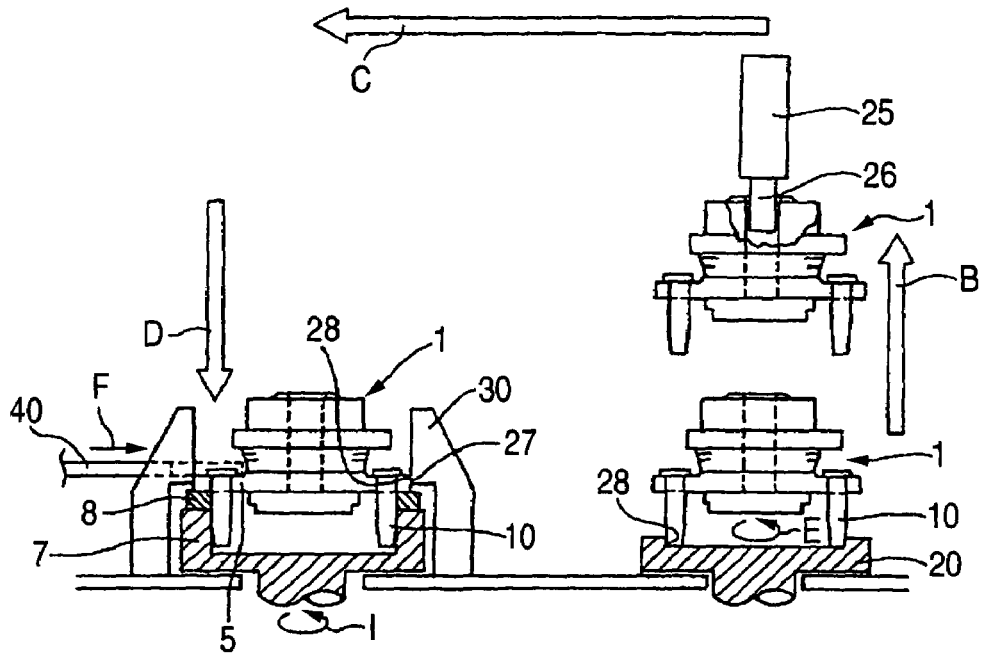
FIG. 2 is a view showing the processing steps of a method of processing an antifriction bearing unit for a wheel according to a first embodiment of the invention.

FIG. 2 is a view showing the processing steps of a method of processing the antifriction bearing unit according to the first embodiment of the invention which are employed for processing the antifriction bearing unit 1 as shown in FIG. 1.

Figure 3:
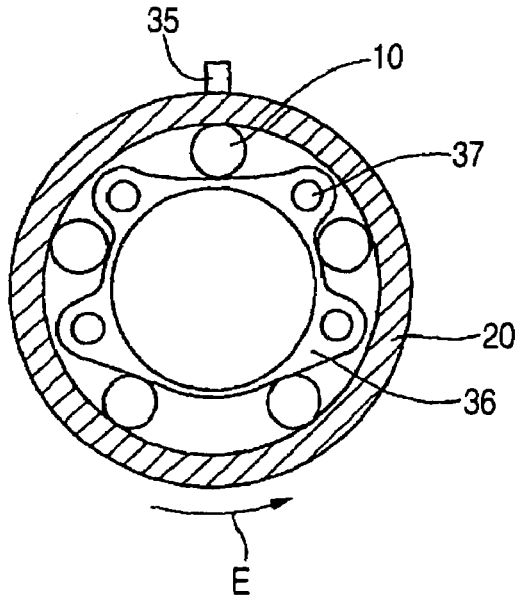
FIG. 3 is a top plan view of the antifriction bearing unit for a wheel as held in position on a positioning table.

The antifriction bearing unit 1 is first mounted on a positioning table 20 by bringing the sides of the bolts 10 of the antifriction bearing unit 1 into axially sliding contact with the shoulder 21 of the positioning table 20 and pushing the bolts 10 toward the positioning table 20 until the ends of the bolts 10 contact the upper surface of the positioning table 20, as shown at the right bottom of FIG. 2. Then, the antifriction bearing unit 1 is rotated on the positioning table 20 in the direction shown by an arrow E in FIGS. 1 and 3 until one of the bolts 10 becomes positioned opposite a sensor 35 installed on the cylindrical outer surface of the positioning table 20, as shown in FIG. 3 which is a top plan view of the antifriction bearing unit for a wheel as mounted on the positioning table 20. Reference numeral 36 in FIG. 3 is the vehicle body mounting flange portion of the outer race 3 which is shown at reference numeral 36 in FIG. 1, and reference numeral 37 are the bolt insertion holes made in the flange portion 36, though no detailed description is made.

Referring now to the right top of FIG. 2, the holding portion 26 of a chuck 25 is inserted within the inner peripheral surface of the inner race 2 and is radially stretched for the chuck 25 to hold the antifriction bearing unit 1 and the chuck 25 holding the antifriction bearing unit 1 is raised vertically upwardly as shown by an arrow B without allowing the antifriction bearing unit 1 to rotate circumferentially. Then, the chuck 25 holding the antifriction bearing unit 1 is transferred in the direction shown by an arrow C and lowered in the direction of an arrow D without allowing the antifriction bearing unit 1 to rotate circumferentially. While the circumferential position of the antifriction bearing unit 1 is kept in the circumferential position as positioned by the positioning table 20, the antifriction bearing unit 1 is mounted on the fixing table 7 as shown in FIG. 1 and the chuck 25 is separated from the antifriction bearing unit 1. The outer cylindrical surface 27 of the flange portion 5 is supported by the inner cylindrical surface 28 of a work guide 30 which is an example of a flange portion supporting member, as shown at the left bottom of FIG. 2, whereby the radial movement of the flange portion 5 is restricted within a specific range so that the shanks of the bolts 10 may not contact the grindstone 8.

Figure 4:
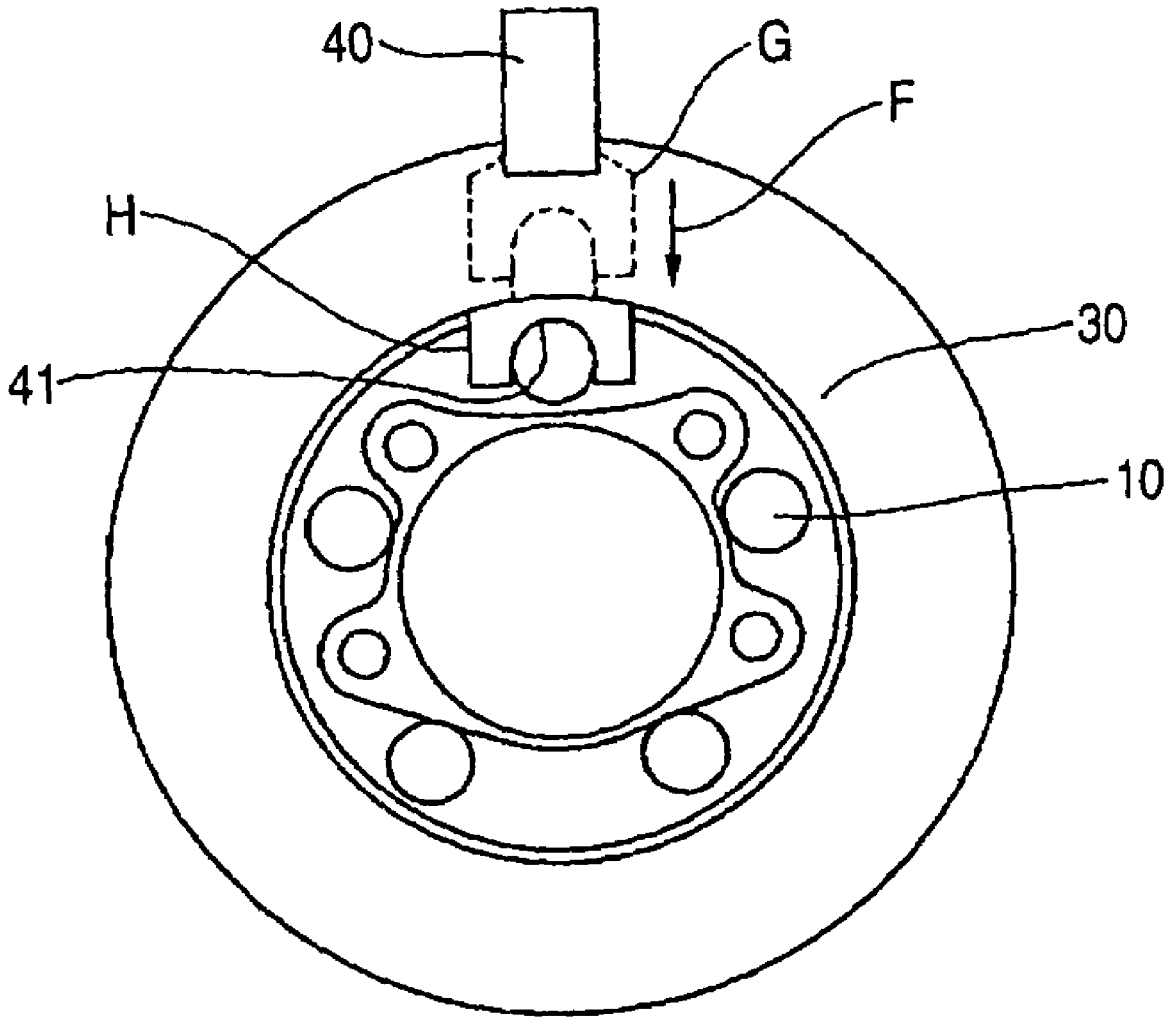
FIG. 4 is a top plan view of the antifriction bearing unit for a wheel as placed in position on the fixing table incapably of circumferential rotation.

Referring now to FIG. 4 which is a top plan view of the antifriction bearing unit 1 supported by the work guide 30, a rod-shaped rotation stop member 40 (as an example of radially movable engaging member) located in that position on the fixing table 7 which corresponds to the position of the sensor 35 on the positioning table 20 as shown in FIG. 3 is moved radially inwardly as shown by an arrow F in FIGS. 2 and 4 from the position shown by a broken line G in FIG. 3 to the position shown by a solid line H through a hole (not shown) made in that portion of the sidewall of the work guide 30 which corresponds to the position of the sensor 35 on the positioning table 20, so that a cylindrical surface 41 formed at the leading end of the rotation stop member 40 and complementary to the head of the bolt 10 will be engaged with the head of the bolt 10 to hold the inner race 2 (see FIG. 1) in position incapably of circumferential rotation.

Finally, with the outer race 3 (see FIG. 1) left free without being fixed, while the inner race 2 is placed in position incapably of circumferential rotation, the fixing table 7 is rotated in the direction shown by an arrow I in FIG. 2 to grind the portion of the flange surface 9 held against the grindstone 8 by the weight of the antifriction bearing unit 1 which lies radially outwardly of the bolts 10 to make the grindstone 8 to remove any undulation or deflection therefrom, thereby improving the flatness of the flange surface 9, in such a manner that the flange surface 9 may not vibrate and not make a juddering sound during the operation of the antifriction bearing unit 1 for a wheel.

The method of processing an antifriction bearing unit according to the first embodiment, while the outer race 3 not having the flange portion 5 as the surface to be ground is left free, the inner race 2 having the flange portion 5 is placed in position incapably of circumferential rotation and the flange surface 9 placed incapably of circumferential rotation and the rotating grindstone 8 are brought into contact with each other for grinding the flange surface 9. Therefore, even if the inner race 2 placed in position incapably of circumferential rotation may receive an eccentric load from the grindstone 8 during the grinding of the flange surface 9, the free outer race 3 does not back up the inner race 2 having the flange portion 5. Accordingly, no large force bears upon the inner or outer race 2, 3 and the rolling elements 4, as opposed to the known method of processing an antifriction bearing unit for a wheel. Therefore, there is no deformation or damage of the inner or outer race 2 or 3 or the rolling elements 4.

The method of processing the antifriction bearing unit according to the first embodiment makes it possible to reduce the time, labor and cost for processing the antifriction bearing unit 1, since the flange surface 9 can be ground simply by bringing the flange surface 9 and the rotating grindstone 8 into contact with each other after the inner race 2 having the flange surface 9 is placed in position incapably of circumferential rotation.

The method of processing the antifriction bearing unit according to the first embodiment makes it possible to make the inner race 2 having the flange surface 9 incapable of circumferential rotation easily and at a low cost, since the rotation stop member 40 is engaged with the head of a bolt 10 extending through the flange portion 5 substantially perpendicularly to the flange surface 9 for placing the inner race 2 having the flange surface 9 in position incapably of circumferential rotation.

The method of processing the antifriction bearing unit according to the first embodiment makes it possible to prevent any shaking or violent motion of the antifriction bearing unit 1 during the grinding of the flange surface 9, since the flange portion 5 is supported by the work guide 30 in a way restricting the radial movement of the flange portion 5 within a specific range when the flange surface 9 and the rotating grindstone 8 are brought into contact with each other. In the case the bolts 10 pass through the flange portion 5 substantially perpendicularly to the flange surface 9, the work guide 30 restricting the radial movement of the flange portion 5 within a specific range makes it possible to prevent the shanks of the bolts 10 from contacting the rotating grindstone 8 during the grinding of the flange surface 9.

Although the method of processing the antifriction bearing unit according to the first embodiment utilizes the weight of the antifriction bearing unit 1 itself for holding it against the fixing table 7 when grinding the flange surface 9, the method of processing the antifriction bearing unit according to this invention may alternatively be carried out by not only utilizing the weight of the antifriction bearing unit itself, but also applying a load to it from vertically above to hold its flange surface to be ground against a grindstone when rotating the grindstone to grind the flange surface with it, after the antifriction bearing unit is placed in position on the fixing table incapably of circumferential rotation. This makes it possible to grind the flange surface with the grindstone in a short time.

Although, according to the first embodiment, this invention has been applied to the antifriction bearing unit 1 for a wheel having a double row of raceway grooves in the outer peripheral surface of the inner race 2 and in the inner peripheral surface of the outer race 3, this invention is alternatively applicable to an antifriction bearing unit for a wheel having a single raceway groove in each of the outer peripheral surface of the inner race and the inner peripheral surface of the outer race. Although this invention has been applied to the antifriction bearing unit 1 for a wheel having the balls 4 as the rolling elements, this invention is also applicable to an antifriction bearing unit for a wheel having rollers as the rolling elements.

Although in the case of the method of processing an antifriction bearing unit for a wheel according to the first embodiment, this invention has been applied to the antifriction bearing unit 1 for a wheel having on the inner race 2 the flange surface 9 for mounting a brake disk thereon directly or indirectly, this invention is also applicable to an antifriction bearing unit for a wheel having on the outer race a flange surface for mounting a brake disk thereon directly or indirectly.

As is obvious from the foregoing, according to the method of processing an antifriction bearing unit for a wheel according to the invention, while the inner or outer race not having the flange surface as the surface to be ground is left free after the outer and inner races and the rolling elements have been put together, the outer or inner race having the flange portion is placed in position incapably of circumferential rotation and the flange surface and the rotating grindstone are brought into contact with each other for grinding the flange surface. Therefore, even if the outer or inner race placed in position incapably of circumferential rotation may receive an eccentric load from the grindstone during the grinding of the flange surface, the free inner or outer race does not back up the outer or inner race having the flange portion, so that there is no deformation or damage of the inner or outer race or the rolling elements.

The method according to the invention makes it possible to reduce the time, labor and cost for processing an antifriction bearing unit for a wheel, since the flange surface can be ground simply by bringing the flange surface and the rotating grindstone into contact with each other after the outer or inner race having the flange portion is placed in position incapably of circumferential rotation.

Further, the method according to the invention makes it possible to make the outer or inner race having the flange portion incapable of circumferential rotation easily and at a low cost, since the engaging means is engaged with the head of a bolt extending through the flange portion substantially perpendicularly to the flange surface for placing the outer or inner race having the flange portion in position incapably of circumferential rotation.

The method according to the invention makes it possible to prevent any shaking or violent motion of the antifriction bearing unit for a wheel during the grinding of the flange surface, since the flange portion is supported by the flange portion supporting member in a way restricting the radial movement of the flange portion within a specific range, when the flange surface and the rotating grindstone are brought into contact with each other.

Second Embodiment

Figure 5:
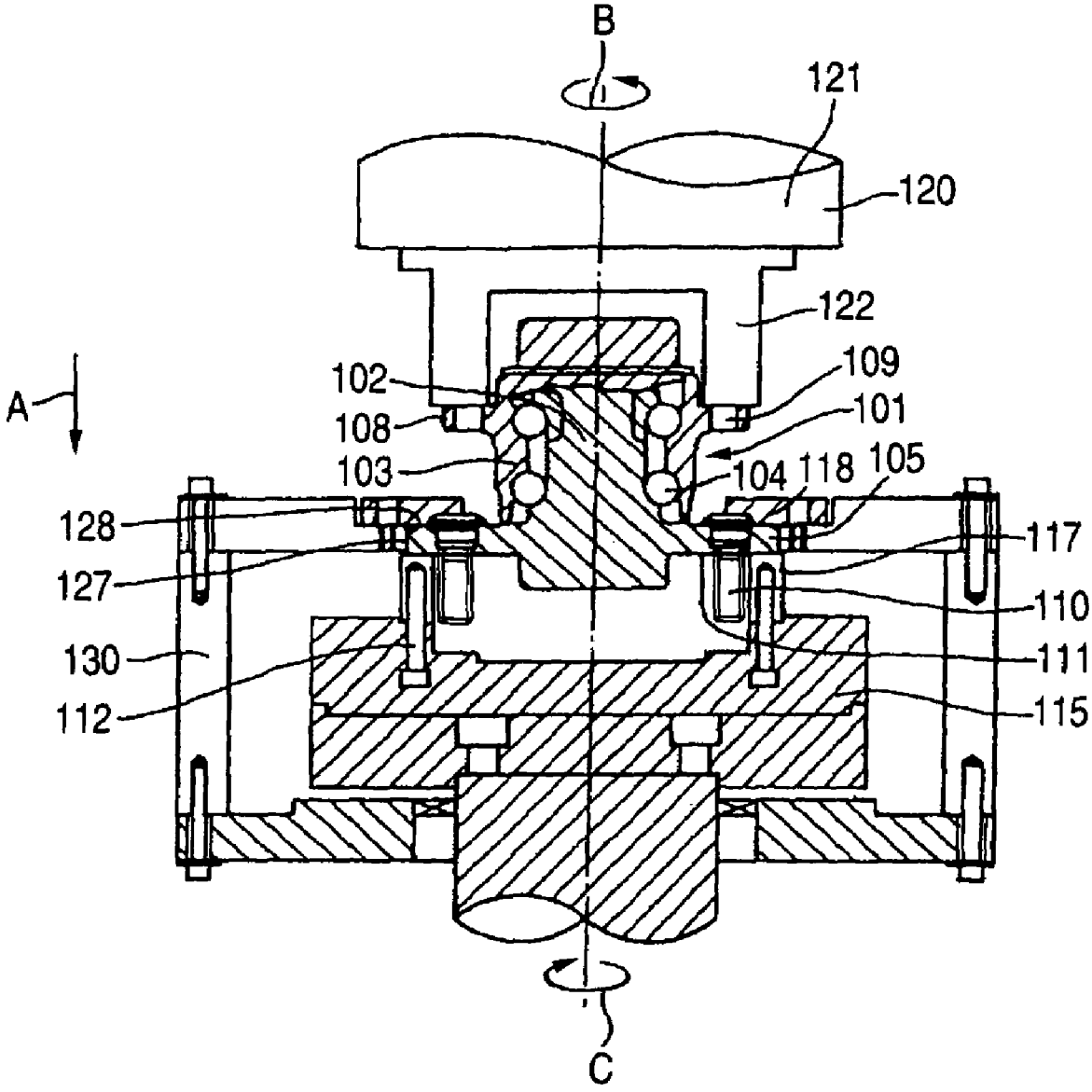
FIG. 5 is a view showing an antifriction bearing unit for a wheel which is being processed by a method of processing an antifriction bearing unit for a wheel according to a second embodiment of this invention.

FIG. 5 is a view showing an antifriction bearing unit 101 for a wheel which is to be processed by a method of processing an antifriction bearing unit for a wheel according to a second embodiment of the present invention.

The antifriction bearing unit 101 includes an inner race 102, an outer race 103 and a plurality of balls 104 (as an example of rolling elements) disposed between two raceway grooves formed in the outer peripheral surface of the inner race 102 and two raceway grooves formed in the inner peripheral surface of the outer race 103.

The inner race 102 has at one axial end thereof a radially spreading disk-shaped flange portion 105 for mounting a brake disk (not shown) thereon directly or indirectly. A plurality of bolt passing holes are formed through the flange portion 105 on a circle concentric thereto and a plurality of bolts 110 each having its shank directed axially outwardly extend through the bolt passing holes, respectively.

The outer race 103 has a radially spreading disk-shaped vehicle body mounting flange 108 at one axial end thereof. A plurality of bolt passing holes 109 in which bolts are inserted for attaching the vehicle body mounting flange 108 to the vehicle body are formed through the disk-shaped vehicle body mounting flange 108 on a circle concentric thereto.

A fixing table 115 is positioned below the antifriction bearing unit 101 as viewed in the vertical direction shown by an arrow A. The fixing table 115 is so constructed as to be rotatable in the direction shown by an arrow C in FIG. 5. The antifriction bearing unit 101 is mounted on the fixing table 115 in such a way that the axially outward flange surface for mounting brake disk 111 of the flange portion 105 faces vertically downward. More specifically, the portion of the flange surface for mounting brake disk 111 which lies radially outwardly of the bolts 110 extending therethrough rests on the upper surface of an annular grindstone 117 that is fixed to the surface of the fixing table 115 by bolts 112 and protrudes vertically upwardly from the fixing table 115. The flange portion 105 includes an outer cylindrical surface 127 supported by the inner cylindrical surface 128 of a work guide 130 which is an example of brake disk mounting flange supporting member. The work guide 130 is so constructed as to be incapable of circumferential rotation. The work guide 130 restricts the radial movement of the flange portion 105 within a specific range so that the shanks of the bolts 110 may not contact the grindstone 117. While the flange portion 105 has its radial movement restricted within a specific range, the head of a bolt 110 extending through the flange portion 105 is engaged by a rotation stop member 118 fixed to the work guide 130 incapably of circumferential rotation to hold the inner race 102 in position on the fixing table 115 incapably of circumferential rotation.

On the other hand, a load applying device 120 is positioned vertically above the antifriction bearing unit 101. The load applying device 120 includes a main body portion 121 and a base portion 122 connected with the main body portion 121 and is so constructed as to be rotatable in the direction shown by an arrow B in FIG. 5 and axially movable. The base portion 122 of the load applying device 120 includes an annular end contacting the vertically upper flange surface of the vehicle body mounting flange 108 on the outer race 103 so that the load applying device 120 will rest on the antifriction bearing unit 101.

In operation, the load applying device 120 located above the antifriction bearing unit 101 is moved down vertically as shown by the arrow A and axially over a specific distance and is rotated circumferentially as shown by the arrow B to apply a specific load to the outer race 103 of the antifriction bearing unit 101 from above the antifriction bearing unit 101 to hold the brake disk mounting surface 111 under a specific pressure against the grindstone 117 and rotate the outer race 103 in the direction of the arrow B, while the fixing table 115 situated below the antifriction bearing unit 11 for a wheel is rotated in the direction shown by the arrow C opposite to the direction of the arrow B to bring the flange surface for mounting brake disk 111 into contact with the grindstone 117 rotating in the direction of the arrow C for grinding it.

The inventors of this invention ground three samples of flange surface for mounting brake disks by employing each of the method according to the second embodiment of this invention as shown at sample 3 below and the comparative methods as shown at sample 1 and sample 2 below and the method according to the first embodiment as shown at sample 4, and measured the amount of corrected flatness of each flange surface for mounting brake disk and the amount of corrected deflection thereof.

Methods of measuring the amount of corrected flatness and measuring the amount of corrected deflection are described.

The amount of corrected flatness is measured by the following way. The outer race of the antifriction bearing unit is put on a turntable of a roundness measuring machine in a state the flange surface to be measured of the inner race is directed upward. The flatness of the flange surface is measured by a probe of the roundness measuring machine contacting the flange surface while the turntable is rotated to rotate the inner and outer races integrally. Reason why the roundness measuring machine is employed is because the machine has a slope correction function, and a slope on the whole of the flange surface (the antifriction bearing unit) is therefore canceled and thereby the flatness can be precisely measured.

The amount of corrected deflection is measured by the following way. The outer race of the antifriction bearing unit is put on an outer ring mounting table in a state that the flange surface to be measured of the inner race is directed upward. A dial gauge is set to the flange surface to be measured. The deflection of the flange surface is measured by reading a fluctuation of the dial gauge while rotating the flange surface (inner race) by one rotation.

Figure 6:
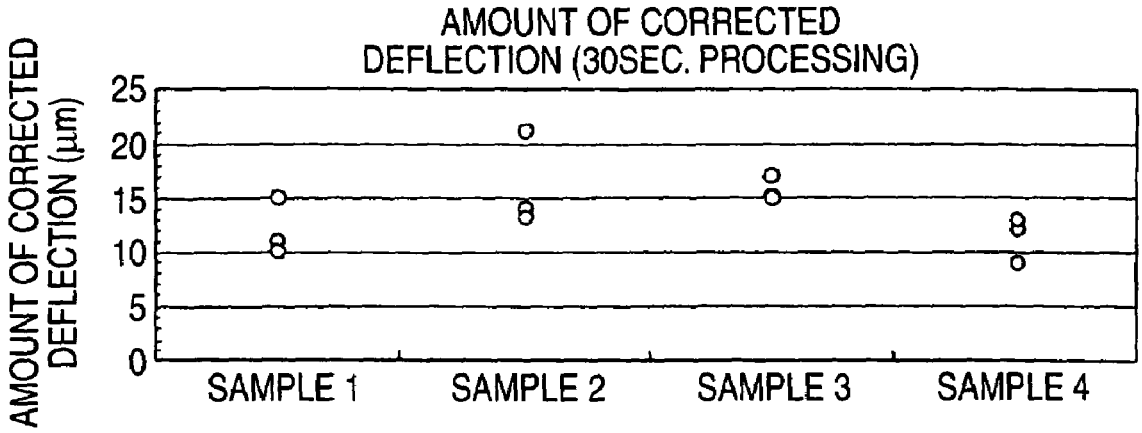
FIG. 6 is a graphical representation of the amounts of corrected deflection of the flange surface for mounting brake disks as shown in Table 1.
Figure 7:
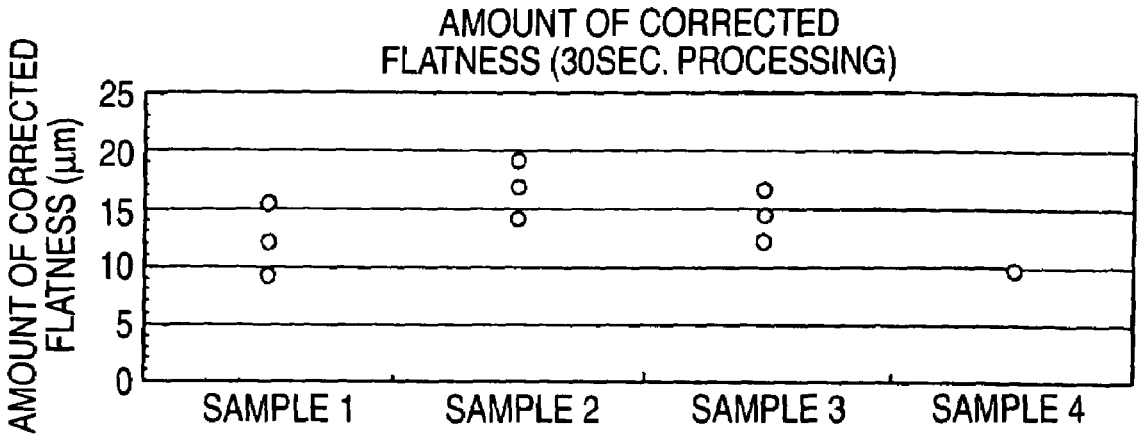
FIG. 7 is a graphical representation of the amounts of corrected flatness of the flange surface for mounting brake disks as shown in Table 1.

Table 1 is a table showing the amounts of corrected deflection of the flange surfaces for brake disk mounting as being ground by employing those methods and the amounts of corrected flatness thereof. FIG. 6 is a graphical representation of the amounts of corrected deflection of the flange surface for mounting brake disks as shown in Table 1, and FIG. 7 is a graphical representation of the amounts of corrected flatness of the flange surface for mounting brake disks as shown in Table 1.

TABLE 1

| | Sample 1 Inner race rotation/ pressure (low) | Sample 2 Inner race rotation/ pressure (high) | Sample 3 Outer race rotation/ pressure (high) | Sample 4 No work rotation/ pressure (own weight), |
|---|---|---|---|---|
| Grindstone rotation ($min^{-1}$) | 500 | 500 | 500 | 500 |
| Inner race flange rotation ($min^{-1}$) | −500 | −500 | — | — |
| Outer race rotation ($min^{-1}$) | — | — | −500 | — |
| Pressure (N) | 225.4 | 323.4 | 323.4 | — |
| Processing time (sec.) | 30 | 30 | 30 | 30 |
| Amount of corrected deflection of Sample 1 (μm) | 11.0 | 13.0 | 15.0 | 9.0 |
| Amount of corrected deflection of Sample 2 (μm) | 10.0 | 13.0 | 15.0 | 9.0 |
| Amount of corrected deflection of Sample 3 (μm) | 15.0 | 14.0 | 15.0 | 12.0 |
| Average of the amounts of corrected deflection of the three Samples (μm) | 12.0 | 16.0 | 15.7 | 11.3 |
| Amount of corrected flatness of Sample 1 flatness of Sample 1 (μm) | 9.2 | 14.1 | 12.2 | 9.8 |
| Amount of corrected flatness of Sample 2 (μm) | 12.1 | 16.8 | 14.5 | 9.7 |
| Amount of corrected flatness of Sample 3 (μm) | 15.4 | 19.0 | 16.6 | 9.8 |
| Average of the amounts of corrected flatness of the three Samples (μm) | 12.2 | 16.6 | 14.4 | 9.8 |

Referring to Table 1, the comparative method of sample 1 is the method in which a load applied for pressing an antifriction bearing unit for a wheel against a fixing table is set low, the inner race having a flange surface for mounting brake disk is rotated, while the outer race not having the flange surface for mounting brake disk is fixed, and an annular grindstone contacting the flange surface for mounting brake disk is rotated in the direction opposite the direction of rotation of the flange surface for mounting brake disk for grinding it.

The comparative method of sample 2 is a method differing from the comparative method of sample 1 only in that the load applied for pressing an antifriction bearing unit for a wheel against the fixing table is set high.

The method of sample 3 is the method according to the second embodiment of this invention as described before, in which a load applied for pressing the antifriction bearing unit against a fixing table is set high, the outer race not having a flange surface for mounting brake disk is rotated, while the inner race having the flange surface is held in position incapably of circumferential rotation, and an annular grindstone contacting the flange surface is rotated in the direction opposite the direction of rotation of the outer race for grinding the flange surface.

The method of sample 4 is the method according to the first embodiment of the invention described above in which the inner race having a flange surface for mounting brake disk is held in position incapably of circumferential rotation, while the outer race not having the flange surface for mounting brake disk is left free, and only the weight of the antifriction bearing unit itself is relied upon for pressing the flange surface against a rotating annular grindstone for grinding it.

The method of sample 3 according to the second embodiment of this invention gave as the average of the amounts of corrected deflection of the three samples a value of 15.7 μm which was by far greater than 12.0 μm as the average of the amounts of corrected deflection of the three samples achieved by the comparative method of the sample 1 and 11.3 μm as the average of the amounts of corrected deflection of the three samples achieved by the method of sample 4 and was substantially equal to 16.0 μm as the average of the amounts of corrected deflection of the three samples achieved by the comparative method of sample 2, as shown in Table 1 above.

As is obvious from the average values of the amounts of corrected deflection of the three samples achieved by the four methods, respectively, and from FIG. 6, the method of sample 3 according to the second embodiment of this invention enables the flange surface of the antifriction bearing unit to have a by far higher level of perpendicularity to its central axis than the comparative method of sample 1 and the method of sample 4 do, and substantially the same level of perpendicularity to its central axis as the comparative method of sample 2 does.

The method of sample 3 according to the second embodiment of this invention gave as the average of the amounts of corrected flatness of the three samples a value of 14.4 μm which was greater than 12.2 μm as the average of the amounts of corrected flatness of the three samples achieved by the comparative method of sample 1 and 9.8 μm as the average of the amounts of corrected flatness of the three samples achieved by the method of sample 4 and was somewhat smaller than 16.0 μm as the average of the amounts of corrected flatness of the three samples achieved by the comparative method of sample 2.

As is obvious from the average values of the amounts of corrected flatness of the three samples achieved by the four methods, respectively, and from FIG. 7, the method of sample 3 according to the second embodiment of this invention enables the flange surface to have a higher level of flatness than the comparative method of sample 1 and the method of sample 4 do, but a somewhat lower level of flatness than the comparative method of sample 2 does.

This is due to the fact that while the comparative method of sample 2 had a grindstone rotation of 500 $min^{-1}$ and an inner race flange rotation of −500 $min^{-1}$ and therefore a relative grindstone rotation of 1000 $min^{-1}$ to the inner race flange having the surface to be ground, the method of sample 3 according to the mode of embodiment of this invention had a grindstone rotation of 500 $min^{-1}$ and a relative grindstone rotation of 500 $min^{-1}$ to the inner race flange having the surface to be ground, as it did not have the inner race flange rotate, as shown in Table 1 above. The method of this invention enables the flange surface to achieve easily by employing a grindstone rotating speed somewhat higher than 500 $min^{-1}$ a level of flatness equal to, or higher than the flatness obtained by employing the comparative method of sample 2. A comparison of the method of sample 3 and the comparative method of sample 2 in the wear of the grindstone has revealed a by far faster wear of the grindstone by the comparative method of sample 2 than by the method of sample 3, because of a great difference therebetween in the relative rotation of the grindstone to the inner race flange having the surface to be ground.

Consequently, the method of sample 3 according to the mode of embodiment of this invention is the best method, since it can realize substantially the same levels of correction of deflection and flatness as the comparative method of sample 2 found to achieve the highest levels of correction of deflection and flatness as well as can achieve much longer life-time of the grindstone as compared with the method of sample 2.

According to the method of processing an antifriction bearing unit for a wheel according to the second embodiment, the flange surface 111 for mounting brake disk placed incapably of circumferential rotation and the rotating grindstone 117 are brought into contact with each other and the flange portion 105 and the outer race 103 is rotated to grind the flange surface 111 in a state that a load is applied to the outer race 103 not having the flange portion 105. Therefore, it is possible to grind the flange surface 111 without having any clearance formed between the inner or outer race 102 or 103 and the balls 104, since the load ensures the absence of any clearance between the inner or outer race 102 or 103 and the balls 104. Accordingly, the inner and outer races 102 and 103 can always be positioned relative to each other via the balls 104 during the grinding of the flange surface 111. Since the outer race 103 is rotated as such for grinding the flange surface, it is possible to grind the flange surface 111, while maintaining the central axis of the anti friction bearing unit perpendicular to the flange surface 111, and thereby obtain a high level of perpendicularity of the central axis of the antifriction bearing unit 101 to the flange surface 111.

According to the method of processing an antifriction bearing unit for a wheel according to the second embodiment, the load is applied to the vehicle body mounting flange 108 on the outer race 103 not having the flange portion 105 on the flange surface of the vehicle body mounting flange 108 opposite to the flange portion 105 and thereby the load is applied to the flange portion 105. Therefore, it is possible to apply a load to the flange portion 105 easily and at a low cost by utilizing effectively the vehicle body mounting flange 108 formed for fixing the antifriction bearing unit 101 to the vehicle body.

The method of processing an antifriction bearing unit for according to the second embodiment makes it possible to prevent any shaking or violent motion of the antifriction bearing unit 101 during the grinding of the flange surface 111, since the flange portion 105 is so supported by the work guide 130 as to have its radial movement restricted within a specific range when the flange surface for mounting brake disk 111 and the rotating grindstone 117 are brought into contact with each other.

The method of processing an antifriction bearing unit according to the second embodiment makes it possible to grind the flange surface 111 while maintaining the antifriction bearing unit 101 stable, since the grindstone 117 is rotated in the direction C opposite to the direction B of rotation of the outer race 103 not having the flange portion 105 when grinding the flange surface 111.

Although in the case of the method of processing an antifriction bearing unit according to the second embodiment, this invention has been applied to the antifriction bearing unit 101 having a double row of raceway grooves in the outer peripheral surface of the inner race 102 and in the inner peripheral surface of the outer race 103, this invention is alternatively applicable to an antifriction bearing unit for a wheel having a single raceway groove in each of the outer peripheral surface of the inner race and the inner peripheral surface of the outer race. Although this invention has been applied to the antifriction bearing unit 101 having the balls 104 as the rolling elements, this invention is also applicable to an antifriction bearing unit for a wheel having rollers as the rolling elements.

Although in the case of the method of processing an antifriction bearing unit according to the second embodiment, this invention has been applied to the antifriction bearing unit 101 having on the inner race 102 the flange surface 111 for mounting a brake disk thereon directly or indirectly, this invention is also applicable to an antifriction bearing unit for a wheel having on the outer race a flange surface for mounting a brake disk thereon directly or indirectly.

Although in the case of the method of processing an antifriction bearing unit according to the second embodiment, the portion of the flange surface 111 which lies radially outwardly of the bolts 110 extending therethrough is ground by the grindstone 117, it is possible to attach to the fixing table 115 an annular grindstone contacting that portion of the flange surface 111 which lies radially inwardly of the bolts 110 and grind both those portions of the flange surface for mounting brake disk 111 which lie radially inwardly and outwardly of the bolts 110.

As is obvious from the foregoing, this invention enables the central axis of an antifriction bearing unit for a wheel to have a high level of perpendicularity to its ground flange surface.

Third Embodiment

Figure 8:
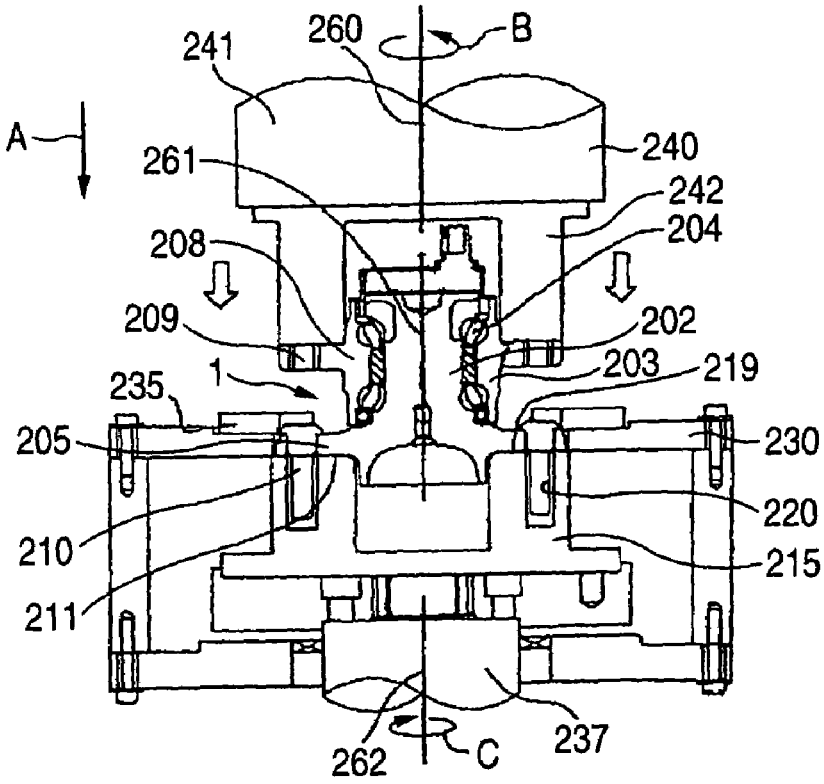
FIG. 8 is a sectional view showing an antifriction bearing unit for a wheel as being processed by a method of processing an antifriction bearing unit for a wheel according to a third embodiment of this invention.

FIG. 8 is a view showing an antifriction bearing unit 201 for a wheel which is to be processed by a method of processing an antifriction bearing unit for a wheel according to a third embodiment of this invention.

The antifriction bearing unit 201 includes an inner race 202, an outer race 203 and a plurality of balls 204 (as an example of rolling elements) disposed between two raceway grooves formed in the outer peripheral surface of the inner race 202 and two raceway grooves formed in the inner peripheral surface of the outer race 203.

The inner race 202 has at one axial end a radially spreading disk-shaped flange portion 205 for mounting a brake disk (not shown) directly or indirectly. A plurality of bolt passing holes are formed in the flange portion 205 on a circle concentric thereto and having its center substantially at the center of the flange portion 205 and a plurality of bolts 210 are inserted and fixed in the bolt passing holes with their shanks directed axially outwardly of the antifriction bearing unit 201.

On the other hand, the outer race 203 includes a radially spreading disk-shaped vehicle body mounting flange 208 at one axial end thereof. A plurality of bolt passing holes 9 for inserting bolts for mounting the vehicle body mounting flange 208 to the vehicle body are formed in the disk-shaped vehicle body mounting flange 208 on a circle concentric thereto and having its center substantially at the center of the disk-shaped vehicle body mounting flange 208.

Figure 9:
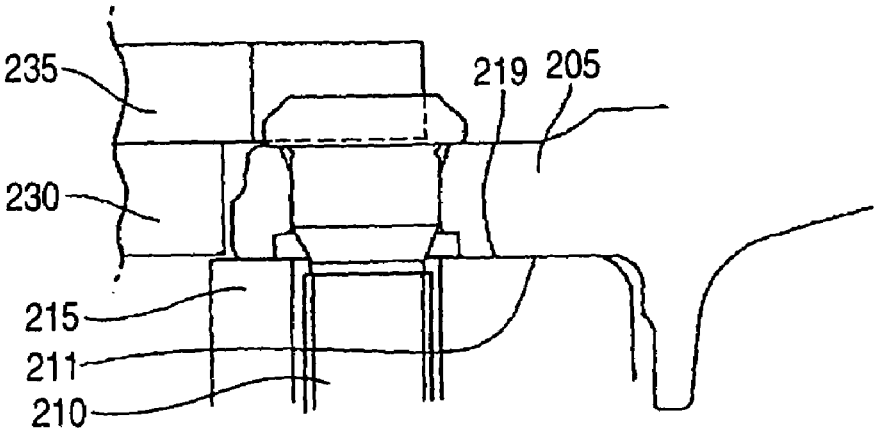
FIG. 9 is an enlarged view of a part in the vicinity of the grinding surface of the grindstone shown in FIG. 8.

A grindstone 215 according to the third embodiment of this invention is positioned below the antifriction bearing unit 201 in the vertical direction shown by an arrow A. The grindstone 215 includes a lower surface attached to the upper surface of a swinging shaft 237 positioned below it in the vertical direction and is swung circumferentially as shown by an arrow C in FIG. 8 when the swinging shaft 237 swings about its central axis 262, or circumferentially as shown by the arrow C. The shanks of the bolts 210, which are protrusions extending through the flange portion 205, are fitted in the slots 220 formed in the grinding surface 219 of the grindstone 215. The brake disk mounting surface 211 of the flange portion 205 that faces vertically downwardly contacts the upper surface of the grindstone 215, that is, grinding surface 219, whereby the antifriction bearing unit 201 rests on the grindstone 215. The method of processing an antifriction bearing unit according to third embodiment makes it possible for the grindstone 215 to grind whole of the brake disk mounting surface 211 radially inwardly and outwardly of the bolts 210, since the grinding surface 219 of the grindstone 215 is larger in radial dimension than the brake disk mounting surface 211, as shown in FIG. 9 which is an enlarged view of an area in the vicinity of the grinding surface 219.

A work guide 230 held incapable of circumferential rotation is positioned radially outwardly of the flange portion 205. The same number of rotation stoppers 235 as the bolts 210 are fixed on the upper surface of the work guide 230 in a way incapable of circumferential rotation. The rotation stoppers 235 engage the heads of the bolts 210 and thus the flange portion 205 is incapable of radial movement and circumferential rotation relative to the work guide 230 when the shanks of the bolts 210 are not in contact with the peripheral surfaces of the slots 220 of the grindstone 217.

On the other hand, a load applying device 240 is positioned above the antifriction bearing unit 201 in the vertical direction. The load applying device 240 includes a main body portion 241 and a base portion 242 connected to the main body portion 241 and is so constructed as to be rotatable about the central axis 260 of its main body portion 241 as shown by an arrow B in FIG. 8 and axially movable. The base portion 242 includes an annular end contacting the vertically upper flange surface of the vehicle body mounting flange 208 of the outer race 203, whereby the load applying device 240 rests on the antifriction bearing unit 201.

Figure 10:
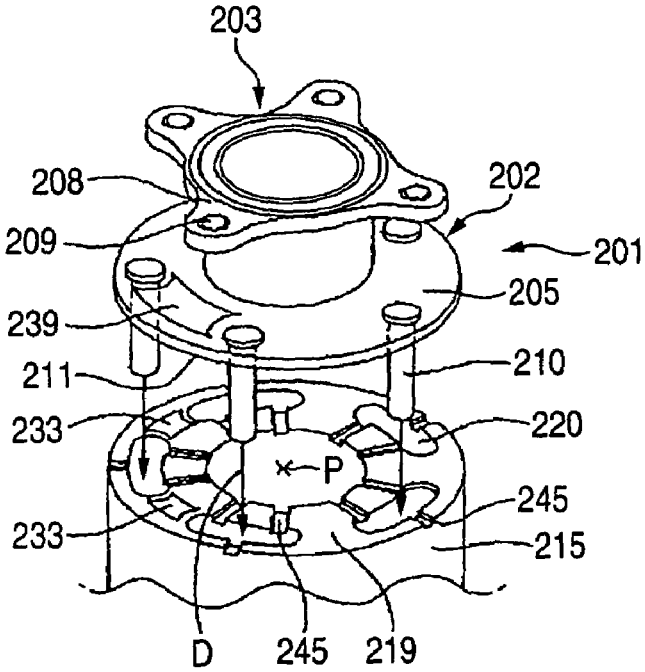
FIG. 10 is a view showing a vehicle body mounting flange, a brake disk mounting flange and a grindstone while an antifriction bearing unit for a wheel is being brought into contact with the grindstone.

FIG. 10 is a view showing the vehicle body mounting flange 208 of the outer race 203, the flange portion 205 of the inner race 202 and the grindstone 215 in a state that the antifriction bearing unit 201 is going to be brought into contact with the grindstone 215 by vertically moving down the antifriction bearing unit 201 as shown by arrows D.

The grindstone 215 includes five slots 220 having a substantially arcuate shape and formed in an equally spaced apart relation from one another on a circle substantially concentric to the grinding surface 219 shaped like a hollow disk and having its center substantially at the center P thereof, as shown in FIG. 10. The circumferentially opposite ends of each of the five slots 220 have a semicircular shape corresponding substantially to the shank of the bolt 210. The grinding surface 219 of the grindstone 215 also has coolant grooves 245 connected with each of the five slots 220 radially inwardly and outwardly thereof. The coolant grooves 245 consist of two grooves connected with each slot 220 radially inwardly thereof and one groove extending radially outwardly from each groove 220. A coolant is caused to flow from two radially inward coolant grooves 245 to one radially outward coolant groove 245 via each slot 220 during the grinding of the brake disk mounting surface 11 to dissipate frictional heat generated between the brake disk mounting surface 211 and the grinding surface 219 of the grindstone 215 and remove grinding dust formed between the brake disk mounting surface 211 and the grinding surface 219 of the grindstone 215.

Figure 11:
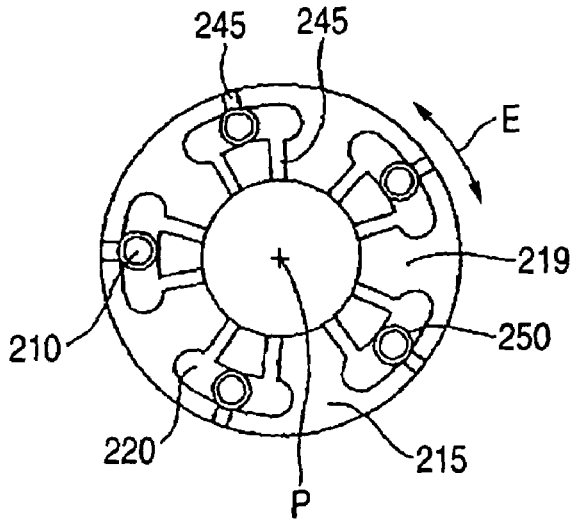
FIG. 11 is a view showing the position of the shanks of bolts in slots in the initial stage preceding the swinging of the grindstone.

FIG. 11 is a view showing the position of the shank of the bolt 210 in each slot 220 in the initial stage preceding the swinging of the grindstone 215.

The bolts 210 are so fitted in the slots 220 that the shank of each bolt may be situated in the circumferential center of the corresponding slot 220, as shown in FIG. 11. The shanks of the bolts 210 have a diameter which is smaller than the radial width of the slots 220, so that a relief clearance 250 may be formed between the sides of the shank of each bolt 210 and the circumferential edges of the corresponding slot 220, as shown in FIG. 11. This makes it possible to prevent the shanks of the bolts 210 from contacting the circumferential edges of the slots 220 during the grinding of the brake disk mounting surface 211. An arrow E shows the swinging amplitude of the grindstone 215. This amplitude is set at a dimension slightly smaller than the length of each slot 220 between its circumferentially opposite ends, so that no contact may occur between the shanks of the bolts 210 and the circumferentially opposite ends of the slots 220 during the grinding.

Referring to FIG. 8, the load applying device 220 located above the antifriction bearing unit 201 is moved down vertically as shown by the arrow A and axially over a specific distance and is rotated circumferentially as shown by the arrow B so that a specific load is applied to the outer race 203 of the antifriction bearing unit 201 from above the antifriction bearing unit 201 and the brake disk mounting surface 211 is pressed by a specific pressure against the grindstone 215 and the outer race 203 in the direction of the arrow B is rotated. On the other hand, the swinging shaft 237 located below the antifriction bearing unit 201 is swung circumferentially as shown by the arrow C and along the swinging amplitude 237 shown by the arrow E in FIG. 11 to grind the brake disk mounting surface 211 contacting the grindstone 215.

As the grindstone 215 according to the second embodiment includes five circumferentially extending substantially arcuate slots 220 formed in the grinding surface 219 in a mutually spaced apart relation on a circle concentric thereto, the shanks of the bolts 210 are allowed to protrude from the brake disk mounting surface 211 of the antifriction bearing unit 201 and the shanks can be received in the slots 220 to bring the grinding surface 219 of the grindstone 215 and the brake disk mounting surface 211 into intimate contact with each other. The grindstone 215 can then be swung circumferentially to grind the brake disk mounting surface 211. Accordingly, the portions 233 (see FIG. 10) of the substantially concentric circle in the grinding surface 19 of the grindstone 215 on which the slots 220 do not exist facilitate the grinding of the portions 239 (see FIG. 10) of the brake disk mounting surface 211 which correspond to those portions of the substantially concentric circle in the grinding surface 219, are difficult to grind and exclude the shanks of the bolts 210. Thus, it is possible to grind easily substantially the whole of the brake disk mounting surface 211 from which the shanks of the bolts 210 protrude, and improve the flatness of the brake disk mounting surface 11 without requiring a large amount of time and labor.

As the grindstone 215 according to the third embodiment has coolant grooves 245 connected with each of the five slots 220, it enables a coolant flowing in the coolant grooves 245 to absorb frictional heat generated during the grinding of the brake disk mounting surface 211 and makes it possible to collect grinding dust occurring during grinding in the slots via the coolant grooves 245 and discharge the grinding dust outside through the coolant grooves 245 even if grinding dust may excessively gather in the slots 220.

The grindstone 215 according to the third embodiment enables grinding dust gathering easily in the slots 220 to be removed efficiently during grinding, as the coolant grooves 245 are connected with each of the five slots 220 radially inwardly and outwardly thereof.

According to the method of processing the antifriction bearing unit 201 using the grindstone 215 described above, the brake disk mounting surface 211 is ground by applying a load to the outer race 203 not having the flange portion 205 and thereby to the flange portion 205, and by rotating the outer race 203 and bringing the brake disk mounting surface 11 held incapable of circumferential rotation and the circumferentially swinging grindstone 215 into contact with each other. The load can prevent any clearance from being formed between the inner and outer races 202 and 203 and the balls 204. Therefore, it is possible to grind the brake disk mounting surface 211 without having any clearance formed between the inner and outer races 202 and 203 and the balls 204 in the antifriction bearing unit 201. Accordingly, the brake disk mounting surface 11 is ground by rotating the outer race 203 without having any clearance formed between the inner and outer races 202 and 203 and the balls 204, i.e. while always having the outer and inner races 202 and 203 positioned relative to each other via the balls 204. The brake disk mounting surface 211 can be ground in a state the antifriction bearing unit 201 has its central axis 261 held perpendicular to the brake disk mounting surface 211. Thus, it is possible for the central axis 261 of the antifriction bearing unit 201 to obtain a high degree of perpendicularity to the brake disk mounting surface 211.

The method of processing the antifriction bearing unit 201 using the grindstone 215 described above makes it possible to apply a load to the flange portion 205 by utilizing effectively the vehicle body mounting flange 208 for securing the antifriction bearing unit 201 to the vehicle body, since the load is applied to the vehicle body mounting flange 208 on the outer race 203 not having the flange portion 205 and thereby to the flange portion 205 from the surface of the vehicle body mounting flange 208 opposite to the flange portion 205.

The method of processing an antifriction bearing unit according to the third embodiment makes it possible to prevent any shaking or violent movement (displacement) of the antifriction bearing unit 201 during its grinding, since the brake disk mounting surface 211 is ground with the flange portion 205 held incapable of radial movement and circumferential rotation relative to the work guide 230.

Although the grindstone 215 according to the third embodiment includes five slots 220 formed in an equally spaced apart relation from one another on a circle substantially concentric with the center P of the grinding surface 219 shaped like a hollow disk, the grindstone of this invention may instead have a plurality of and other than five slots formed in an equally spaced apart relation from one another on a circle substantially concentric to the center of the grinding surface shaped like a hollow disk. The grindstone 215 of this invention may alternatively have a plurality of slots 220 formed in an unequally spaced apart relation on a circle substantially concentric to the center of the grinding surface shaped like a hollow disk.

Although the grindstone 215 according to the third embodiment has the radially extending coolant grooves 245, the grindstone of this invention may instead have circumferentially extending coolant grooves. The grindstone of this invention may alternatively not have any coolant groove.

According to the method of processing an antifriction bearing unit 201 according to the third embodiment, in the flange mounting and flange surface grinding steps after the step of preparing an antifriction bearing unit, the shanks of the bolts 210 are fitted in the slots 220 of the grindstone 215 to bring the brake disk mounting surface 211 and the grinding surface 219 of the grindstone 215 into contact with each other and the grindstone 215 is swung circumferentially with the brake disk mounting surface 211 held incapable of radial movement and circumferential rotation relative to the work guide 230 to grind the brake disk mounting surface 211. Alternatively, following procedure can be taken that after the step of preparing an antifriction bearing unit for a wheel, first the flange mounting step is carried out by mounting the brake disk mounting surface on a supporting member in a way incapable of circumferential rotation and then the grindstone approaches the brake disk mounting surface from which the shanks of the bolts protrude to fit the shanks of the bolts in the slots of the grindstone to bring the brake disk mounting surface and, after that, the flange grinding step is carried out.

Although in the case of the method of processing an antifriction bearing unit 201 according to the third embodiment, this invention has been applied to the antifriction bearing unit 201 having a plurality of raceway grooves in the outer peripheral surface of the inner race 202 and in the inner peripheral surface of the outer race 203, this invention is alternatively applicable to an antifriction bearing unit for a wheel having a single raceway groove in each of the outer peripheral surface of the inner race and the inner peripheral surface of the outer race. Although this invention has been applied to the antifriction bearing unit 201 having the balls 204 as the rolling elements, this invention is also applicable to an antifriction bearing unit having rollers as the rolling elements.

Although in the case of the method of processing an antifriction bearing unit 201 for a wheel according to the third of embodiment, this invention has been applied to the antifriction bearing unit 201 having on the inner race 202 the brake disk mounting surface 211 for mounting a brake disk directly or indirectly, this invention is also applicable to an antifriction bearing unit for a wheel having on the outer race a brake disk mounting surface for mounting a brake disk directly or indirectly.

Although in the case of the method of processing an antifriction bearing unit 201 for a wheel according to the third embodiment, grinding is performed while applying pressure to the outer race 203 and rotating it in the direction of the arrow B by using the load applying device 240, the method of processing an antifriction bearing unit for a wheel according to this invention may alternatively rely upon only the weight of the antifriction bearing unit for a wheel without using any load applying device for grinding the brake disk mounting surface.

What is claimed is:

1. An apparatus for processing an antifriction bearing unit for a wheel, the antifriction bearing unit including an outer race, an inner race, a plurality of rolling elements, a first flange portion for directly or indirectly mounting a brake disk provided to one of the outer and inner races, and a bolt that passes through the first flange portion, the apparatus comprising:

a fixing table that mounts the one of outer and inner races and is adapted to rotate;

a grindstone that is provided to the fixing table and is adapted to grind the first flange portion in a state that the one of outer and inner races is mounted on the fixing table; and an engaging member that is movable in a radial direction of the fixing table and is adapted to be engaged with the bolt passing through the first flange portion to prevent the first flange portion from rotating when the fixing table mounting the one of the outer and inner races is rotated.

2. The apparatus according to claim 1, further comprising:

a supporting member that supports the first flange portion to have radial movement of the first flange portion restricted within a predetermined range when the first flange portion and the grindstone are brought into contact with each other.

3. The apparatus according to claim 1, further comprising:

a load applying device that applies a load in an axial direction against the grindstone to the other of the inner and outer races and rotates the other of the inner and outer races when the first flange portion is ground.

4. The apparatus according to claim 1, wherein the load applying device applies the load to a second flange portion formed at the other of the inner and outer races.

5. The apparatus according to claim 3, wherein the grindstone is rotated in a direction opposite to a direction of rotation of the other of the inner and outer races.

* * * * *